US008245703B2

(12) United States Patent
Cadeau et al.

(10) Patent No.: US 8,245,703 B2
(45) Date of Patent: Aug. 21, 2012

(54) BURNER RING

(75) Inventors: Christophe Cadeau, Lipsheim (FR); Jörn Naumann, Offenburg (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 545 days.

(21) Appl. No.: 12/514,493

(22) PCT Filed: Nov. 12, 2007

(86) PCT No.: PCT/EP2007/062213

§ 371 (c)(1),
(2), (4) Date: May 12, 2009

(87) PCT Pub. No.: WO2008/058931

PCT Pub. Date: May 22, 2008

(65) Prior Publication Data

US 2010/0051013 A1 Mar. 4, 2010

(30) Foreign Application Priority Data

Nov. 13, 2006 (DE) ..... 10 2006 053 426

(51) Int. Cl.
*F23D 14/06* (2006.01)

(52) U.S. Cl. ..... 126/39 E; 126/39 R; 126/39 H; 431/354; 431/284; 431/266; 431/268; 431/198; 239/558; 239/561

(58) Field of Classification Search ..... 126/39 E, 126/39 R, 39 H; 431/354, 284, 266, 198, 431/268; 239/558, 561
See application file for complete search history.

(56) References Cited

U.S. PATENT DOCUMENTS

| | | | | |
|---|---|---|---|---|
| 2,344,144 | A * | 3/1944 | Hobson | 126/39 R |
| 3,042,110 | A * | 7/1962 | Weber et al. | 431/349 |
| 4,518,346 | A | 5/1985 | Pistien | |
| 5,277,576 | A | 1/1994 | Hartung et al. | |
| 5,401,164 | A | 3/1995 | Yen | |
| 5,639,232 | A | 6/1997 | Bogenschutz et al. | |
| 5,690,483 | A | 11/1997 | Oda et al. | |
| 5,800,159 | A * | 9/1998 | Maughan et al. | 431/349 |
| 5,842,849 | A | 12/1998 | Huang | |
| 6,035,846 | A | 3/2000 | Saleri | |
| 6,132,205 | A | 10/2000 | Harneit | |
| 6,325,619 | B2 * | 12/2001 | Dane | 431/284 |
| 7,901,205 | B2 * | 3/2011 | Trochou | 431/284 |

FOREIGN PATENT DOCUMENTS

| | | |
|---|---|---|
| DE | 20016506 U1 | 12/2000 |
| DE | 20019731 U1 | 12/2001 |
| WO | 0225170 A1 | 3/2002 |

* cited by examiner

*Primary Examiner* — Steven B McAllister
*Assistant Examiner* — Avinash Savani
(74) *Attorney, Agent, or Firm* — James E. Howard; Andre Pallapies

(57) ABSTRACT

A burner ring for a gas burner, the burner ring including an outer circumference and an inner circumference, a distribution chamber having gas outlets to the outer circumference of the burner ring, a transfer ignition groove that is outwardly open on one side and extends between the inner circumference of the burner ring and the outer circumference of the burner ring, a gas conducting channel into which the transfer ignition groove opens at least partially, and at least one gas supply opening between the distribution chamber and the gas conducting channel, wherein the gas conducting channel and the transfer ignition groove are arranged mutually symmetrically, and wherein the at least one gas supply opening is offset in a region of the gas conducting channel at an angle relative to the transfer ignition groove.

29 Claims, 5 Drawing Sheets

BURNER RING

The invention relates to a burner ring for gas burners that has a distribution chamber having gas outlets to the burner ring's outer circumference, and further has a transfer ignition groove that is outwardly open on one side and extends between an inner circumference of the burner ring and the burner ring's outer circumference, a gas conducting channel into which the transfer ignition groove opens at least partially, and at least one gas supply opening between the distribution chamber and gas conducting channel. The invention relates further to a gas burner having a burner ring of such type, with the burner ring surrounding an inner region of the gas burner and the gas outlets producing the main flame on the outer circumference. In particular an ignition plug and a thermoelement can be located in the inner region.

BACKGROUND OF THE IVENTION

Burner rings having simple transfer ignition grooves are known from, for instance, WO 02/25170, DE 200 16 506 U1, and DE 200 19 731 U1. A generic burner ring and gas burner are known from, for example, DE 41 25 308 A1.

A gas flame produced on one side of the burner ring, particularly in the inner region, is transported to the other side of the burner ring by way of the transfer ignition groove so that both gas or, as the case may be, burning rings can be ignited with just one ignition plug.

It is disadvantageous in the case of the arrangement according to DE 41 25 308 A1 that a flame fringe running along the transfer ignition groove is formed unevenly during operation.

SUMMARY OF THE INVENTION

The object of the invention is hence to provide a possibility for realizing a more even flame fringe along the transfer ignition groove between the inner and outer ring.

The objects are achieved by means of a burner ring and a gas burner according to the exemplary embodiments disclosed herein.

The burner ring has a distribution chamber having gas outlets to the outer circumference of the burner ring, and further has a transfer ignition groove that is outwardly open on one side and extends between an inner circumference of the burner ring and the burner ring's outer circumference, a gas conducting channel into which the transfer ignition groove opens at least partially, and at least one gas supply opening between the distribution chamber and gas conducting channel. The gas conducting channel and transfer ignition groove are arranged mutually symmetrically and the gas conducting channel is offset in the region of the gas conducting channel at an angle relative to the transfer ignition groove.

Said burner ring is based on the knowledge the oblique impacting of a gas stream ducted into the gas conducting channel on the opposite wall thereof will cause the gas stream to be distributed and exit along the transfer ignition groove relatively evenly, as a result of which the flame fringe will become more even. Conversely, in the prior art according to DE 41 25 308 A1 a substantial portion of the gas stream entering the gas conducting channel is ducted almost directly into the only laterally offset transfer ignition groove, which results in an uneven distribution.

It will be advantageous for the gas conducting channel to be sealed toward the inner circumference as that will reduce the concentration of exhaust gas as well as the possible formation of soot.

The gas conducting channel can alternatively also be open toward the inner circumference, which will result in an increased formation of soot and a greater concentration of exhaust gas compared with a sealed opening. That effect will be lesser the less the inner burner's power is. The gas conducting channel can alternatively also be open or closed on both sides.

For an evenly distributed gas supply it will be advantageous for there to be more than one gas supply opening, particularly for at least two gas supply openings to be arranged mutually offset at an angle. It is, though, alternatively or additionally possible (for example when there are more than two gas supply openings) for at least two gas supply openings to be arranged symmetrically offset at an angle relative to the transfer ignition groove.

It will be advantageous from the manufacturing viewpoint for the transfer ignition groove to be located on the top side of the gas conducting channel and for at least one gas supply opening to enter the bottom half of the gas conducting channel.

The object is achieved also by means of a gas burner, particularly a two-ring gas burner, having a burner ring of such type, particularly if the burner ring surrounds an inner region of the gas burner and the gas outlets on the outer circumference produce the main flame.

The gas burner will be embodied particularly advantageously if an ignition plug and a thermoelement project into the inner region and if an inner burner is secured within the inner region, especially coaxially.

The burner ring can in particular be embodied for interoperating with a burner according to DE 41 25 308 A1, WO 02/25170, DE 200 16 506 U1, or DE 200 19 731 U1 and for replacing the burner ring disclosed therein. The burner ring can for that purpose have, for example, guide grooves etc.

BRIEF DESCRIPTION OF THE DRAWINGS

The burner ring is described schematically in more detail in the exemplary embodiment that follows. Elements that are the same are therein identified throughout by the same reference numerals. Said exemplary embodiment is not intended to limit the invention.

DETAILED DESCRIPTION OF THE EXEMPLARY EMBODIMENTS OF THE PRESENT INVENTION

Figure 1:
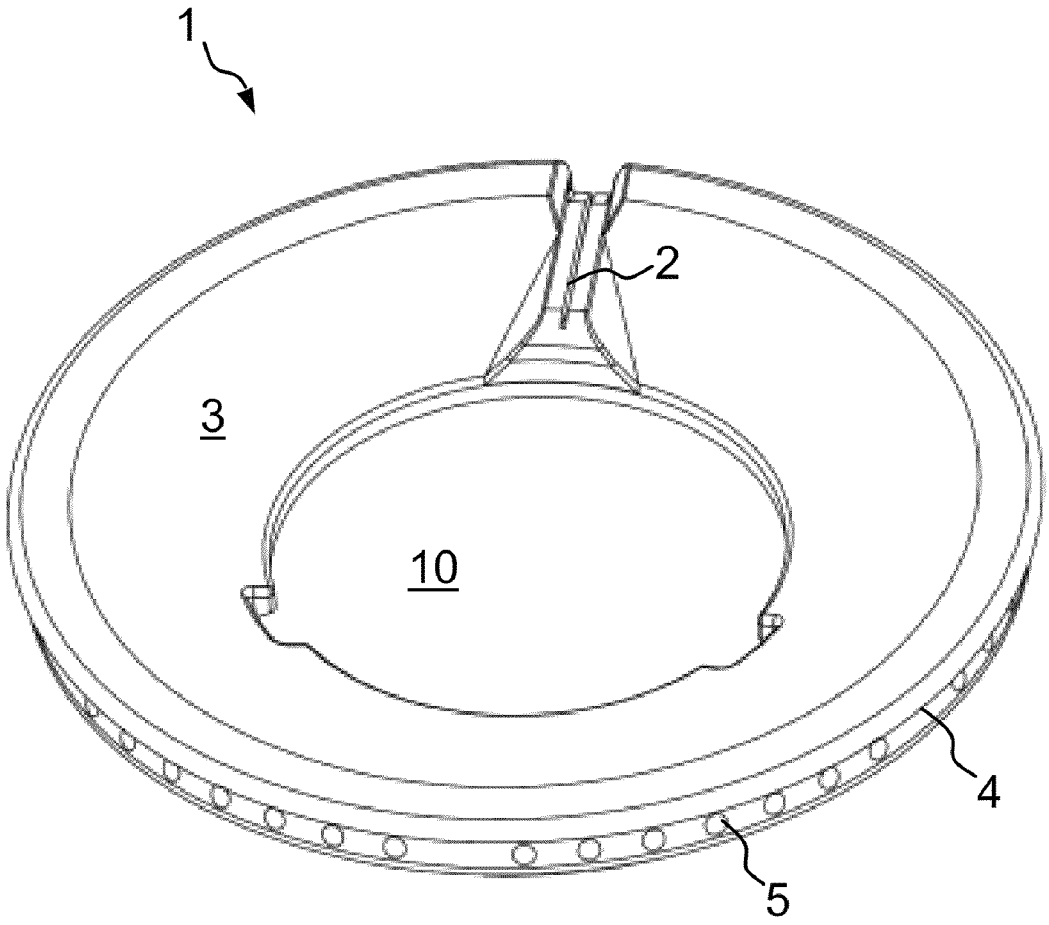
FIG. 1 is an oblique top view of a burner ring.

FIG. 1 is an oblique top view of a burner ring 1 for a two-ring gas burner in the direction of a transfer ignition groove 2. The upwardly open transfer ignition groove 2 connects an inner circumference 3 of the burner ring 1 to an outer circumference 4 of the burner ring 1. The outer circumference 4 is furnished with gas outlets 5 connected to a distribution chamber (not shown) arranged in a circular manner in the burner ring 1. The inner circumference 3 of the burner ring 1 when mounted in a gas burner surrounds an inner region of the gas burner while the gas outlets 5 on the outer circumference 4 produce the main flame.

Figure 2:
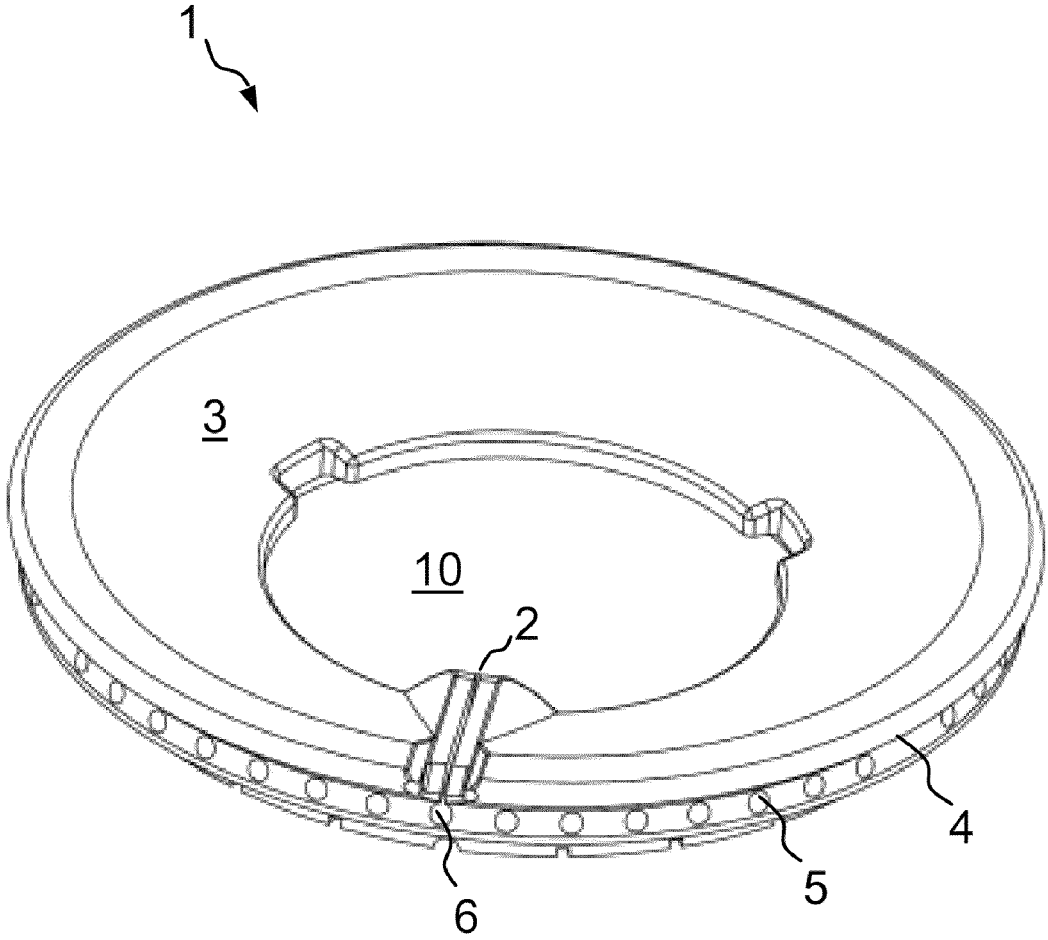
FIG. 2 is an oblique top view of a burner ring from a direction opposite that of FIG. 1.

FIG. 2 is an oblique top view of the burner ring 1 shown in FIG. 1 from an opposite perspective. Shown in addition to the elements illustrated in FIG. 1 is a gas conducting channel 6 in the form of a drilled hole into which the transfer ignition groove 2 opens downwardly. The gas conducting channel 6 and transfer ignition groove 2 are arranged mutually symmetrically, with the transfer ignition groove 2 running parallel to the gas conducting channel 6 and feeding into it at its top vertex. The longitudinal axis (not drawn) of the gas conducting channel 6 is thus located in the plane defined by the groove 2.

FIGS. 1 and 2 show that the gas conducting channel 6 is sealed toward the inner circumference 3 and open toward the outer circumference 4.

Figure 3:
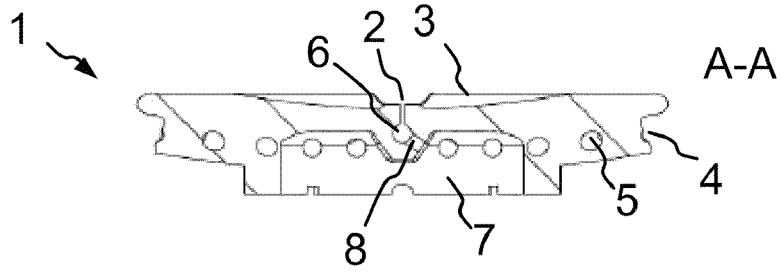
FIG. 3 is a cross-section through the burner ring shown in FIG. 1 at the site of the transfer ignition groove along an intersection line A-A shown in FIG. 4.
Figure 4:
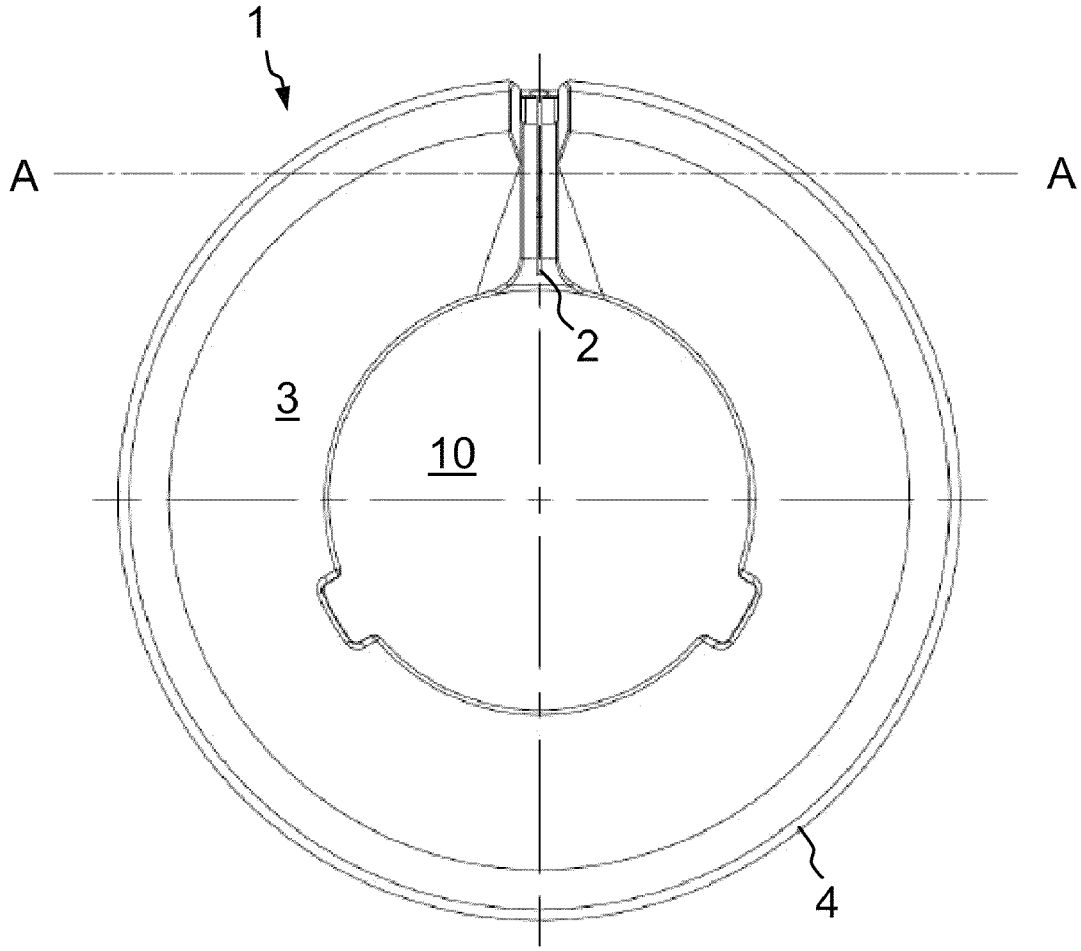
FIG. 4 is a top view of the burner ring shown in FIG. 1.

FIG. 3 is a cross-section through the burner ring 1 (smaller component part) along an intersection line A-A of the burner ring 1 of which a top view is shown in FIG. 4. The gas conducting channel 6 arranged symmetrically with respect to the transfer ignition groove 2 extends above a downwardly open distribution chamber 7. The distribution chamber 7 is connected to the gas conducting channel 6 by two gas supply openings 8 in the form of drilled holes, only one of which is shown here. The gas supply opening 8 runs offset at an angle relative to the transfer ignition groove into the gas conducting channel 6. Because a gas stream ducted through the gas supply opening 8 into the gas conducting channel 6 impacts obliquely on the opposite wall thereof, the gas stream will be distributed relatively evenly and consequently exit through the transfer ignition groove in a more distributed manner, as a result of which the flame fringe will be more even.

Figure 6:
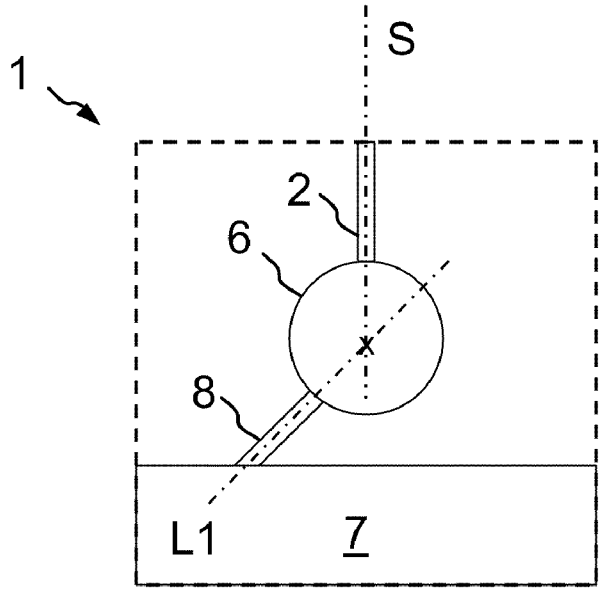
FIG. 6 is a sketch of a cross-section through the burner ring similar to FIG. 3.

In the embodiment variant shown there is a second gas supply opening or, as the case may be, drilled hole (not shown) that is arranged offset at an angle relative to the first gas supply opening shown, in particular at a location mirroring the groove plane, so that the same absolute angle will be assumed relative to the groove 2, as shown in more detail in FIG. 6.

The transfer ignition groove 2 is in the embodiment variant shown located on a top side of the gas conducting channel 6 and the gas supply openings 8 enter a bottom half of the gas conducting channel 6.

Figure 5:
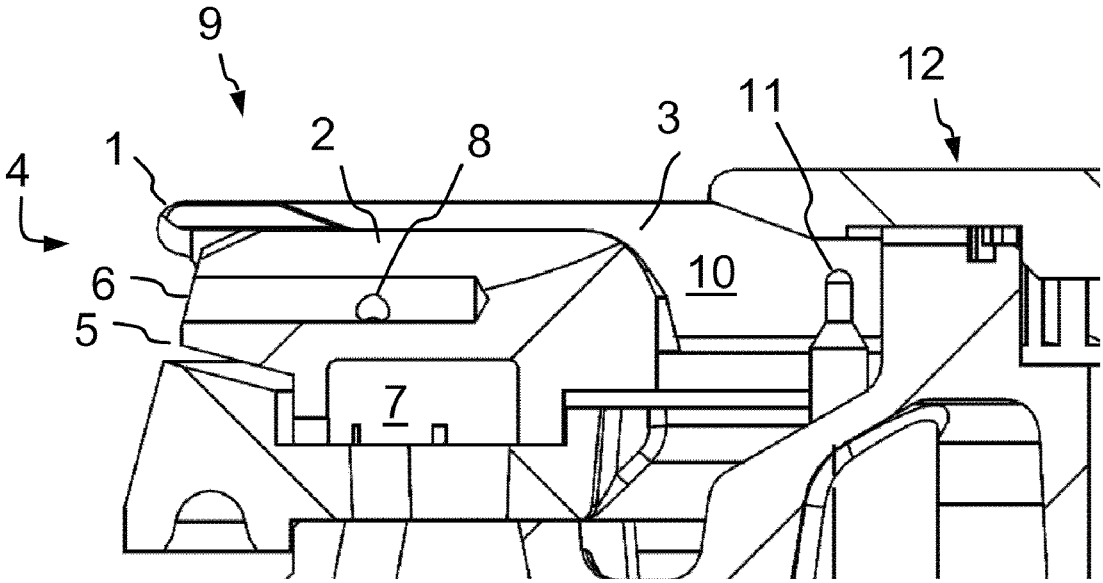
FIG. 5 is a section of a gas burner having a burning ring shown in FIG. 1.

FIG. 5 shows a gas burner 9 having an emplaced burner ring 2. The burner ring 2 surrounds an inner region 10 of the gas burner 2 in which there are an ignition plug (not shown) and a thermoelement 11 and an inner burner 12 is secured coaxially. A gas flame can be ignited on the inner burner 12 by the ignition plug. If gas is applied to the distribution chamber 7 for operating the outer main flame, the gas will be distributed through the gas outlets 5 as well as from the distribution chamber 7 through the gas supply openings 8 into the gas conducting channel 6 and then through the transfer ignition groove 2 to the exterior. When a flame is burning in the inner region, the flame will spread via the transfer ignition groove 2 to the outer circumference 4 of the burner ring 1 and ignite the main flame.

Figure 7:
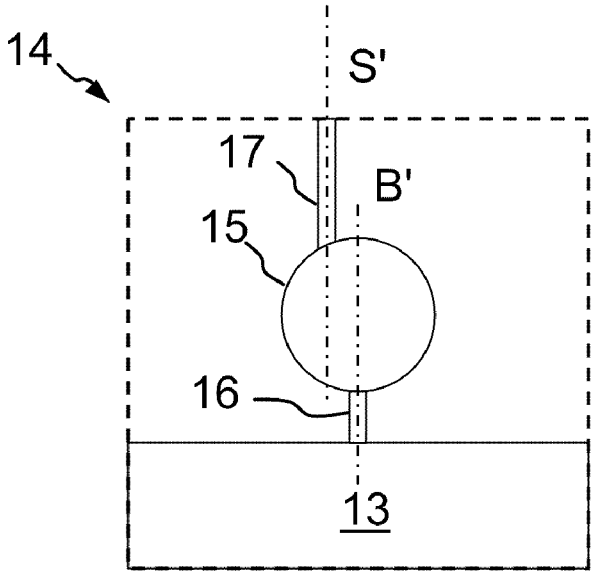
Prior Art FIG 7
FIG. 7 is a sketch, analogous to FIG. 6, of a cross-section through a burner ring according to the prior art.

For clarification with the aid of a sketched cross-section through a burner ring, FIG. 6 and FIG. 7 show the difference between the inventive embodiment variant shown in the above figures, FIG. 6, and the prior art, FIG. 7.

In FIG. 6 the distribution chamber 7 is connected to the gas conducting channel 6 by means, in this case, of a gas supply opening 8 running offset at an angle relative to the transfer ignition groove 2 into the gas conducting channel 6, as shown by the relative position of a longitudinal axis B of the gas supply opening 8 and a plane S of the transfer ignition groove 2. Drawn in dashed lines is a further gas supply opening 8 that is arranged in mirrored fashion in terms of the groove plane S and is offset relative to the first gas supply opening 8 along the longitudinal axis of the gas conducting channel 6 indicated by the cross. The gas supply opening 8 can alternatively also be arranged symmetrically with respect to the transfer ignition groove 2 so that they would be located one behind the other in a representation analogous to FIG. 6.

In FIG. 7 according to the prior art a distribution chamber 13 of a burner ring 14 is connected to a first drilled hole 15 by a second drilled hole 16 which, laterally offset with respect to a transfer ignition groove 17, runs into the first drilled hole 15, as shown by the relative position of a longitudinal axis B' of the second drilled hole 16 and a plane S' of the transfer ignition groove 17.

What is shown is not, of course, limited to the embodiment variant described. Thus there can be just one or else more than two gas supply openings 8, with the possibility also of their not being mutually offset at an angle when there are two or more gas supply openings 8. The groove 2 can, for example, also run obliquely to the exterior. The gas conducting channel 6 and gas supply openings 8 can also have forms other than that of a drilled hole.

List Of Reference Signs

1 Burner ring
2 Transfer ignition groove
3 Inner circumference
4 Outer circumference
5 Gas outlet
6 Gas conducting channel
7 Distribution chamber
8 Gas supply opening
9 Gas burner
10 Inner region
11 Thermoelement
12 Inner burner
13 Distribution chamber
14 Burning ring
15 First drilled hole
16 Second drilled hole
17 Transfer ignition groove
A Section
B Longitudinal axis
B' Longitudinal axis
S Plane
S' Plane

The invention claimed is:

1. A burner ring for a gas burner, the burner ring comprising:

an outer circumference and an inner circumference;

a distribution chamber having gas outlets to the outer circumference of the burner ring, a transfer ignition groove that is outwardly open on one side and radially extends between the outer circumference of the burner ring and the inner circumference of the burner ring, a radially extending gas conducting channel into which the transfer ignition groove opens at least partially, the gas conducting channel having a longitudinal axis that radially extends at least partly between the inner and outer circumferences, and at least one gas supply opening between the distribution chamber and the gas conducting channel, wherein the gas conducting channel and the transfer ignition groove are arranged mutually symmetrically, and wherein the at least one gas supply opening is offset in a region of the gas conducting channel at an angle relative to the transfer ignition groove.

2. The burner ring as claimed in claim 1, wherein the gas conducting channel is sealed toward the inner circumference.

3. The burner ring as claimed in claim 1, wherein the gas conducting channel is open toward the inner circumference.

4. The burner ring as claimed in claim 1, wherein the at least one gas supply opening includes a plurality of gas supply openings.

5. The burner ring as claimed in claim 4, wherein at least two gas supply openings of the plurality of gas supply openings are arranged mutually offset at an angle.

6. The burner ring as claimed in claim 4, wherein at least two gas supply openings of the plurality of gas supply openings are arranged symmetrically.

7. The burner ring as claimed in claim 1, wherein the transfer ignition groove is located on a top side of the gas conducting channel and the at least one gas supply opening enters a bottom half of the gas conducting channel.

8. The burner ring as claimed in claim 1, wherein the transfer ignition groove is upwardly open.

9. The gas burner comprising a burner ring as claimed in claim 1.

10. The gas burner as claimed in claim 9, wherein the burner ring surrounds an inner region of the gas burner, and wherein the gas outlets on the outer circumference produce the main flame.

11. The gas burner as claimed in claim 10, comprising:

an ignition plug and a thermo element located in the inner region; and an inner burner secured within the inner region.

12. The gas burner as claimed in claim 11, wherein the inner burner is secured coaxially within the inner region.

13. A burner ring for a gas burner, the burner ring comprising:

an inner circumference defining an inner region;

an outer circumference;

a distribution chamber;

a plurality of gas outlets connecting the distribution chamber of the burner ring to an exterior of the burner ring;

an upwardly open transfer ignition groove that extends between the outer circumference of the burner ring and the inner circumference of the burner ring, a gas conducting channel, wherein the upwardly open transfer ignition groove at least partially opens into the gas conducting channel, and at least one gas supply opening between the distribution chamber and the gas conducting channel, wherein the gas conducting channel and the upwardly open transfer ignition groove are arranged mutually symmetrically, wherein the upwardly open transfer ignition groove has a longitudinal axis that is parallel to a longitudinal axis of the gas conducting channel, and the upwardly open transfer ignition groove feeds a top vertex of the gas conducting channel, and wherein the at least one gas supply opening is offset at an angle relative to the upwardly open transfer ignition groove in a region of the gas conducting channel.

14. The burner ring as claimed in claim 1, wherein the gas conducting channel is substantially parallel to the transfer ignition groove, said transfer ignition groove including an elongated opening extending along the longitudinal axis of the gas conducting channel.

15. The burner ring as claimed in claim 14, wherein the elongated opening extends from the inner circumference to the outer circumference.

16. A burner ring for a gas burner, the burner ring comprising:

an outer circumference and an inner circumference;

a distribution chamber having gas outlets to the outer circumference of the burner ring, a gas conducting channel having a longitudinal axis that extends in a radial direction relative to the inner and outer circumferences, the gas conducting channel having a an outer radial end placed adjacent the outer circumference, such that the outer radial end is positioned adjacent the gas outlets;

a transfer ignition groove adapted to transfer a gas flame from the inner circumference to the outer circumference to ignite gas streamed through the gas outlets, the transfer ignition groove extending in the radial direction and being at least partly coextensive with the gas conducting channel, the transfer ignition groove having a lower end communicating with the gas conducting channel and an upper end that is upwardly open along at least an elongated portion of the longitudinal axis of the gas conducting channel; and at least one gas supply opening to supply gas from the distribution chamber to the gas conducting channel, wherein the gas supply opening and the transfer ignition groove are arranged relative to one another and the distribution chamber to avoid direct streaming of gas from the gas supply opening to the transfer ignition groove.

17. The burner ring as claimed in claim 16, wherein the gas conducting channel and the transfer ignition groove are arranged mutually symmetrically.

18. The burner ring as claimed in claim 16, wherein, in cross section, the transfer ignition groove extends in a plane that intersects the longitudinal axis of the gas conducting channel.

19. The burner ring as claimed in claim 18, wherein a longitudinal axis of the gas supply opening intersects the plane of the transfer ignition groove at the longitudinal axis of the gas conducting channel.

20. The burner ring as claimed in claim 18, wherein a longitudinal axis of the gas supply opening and the plane of the transfer ignition groove are not parallel to one another.

21. The burner ring as claimed in claim 16, wherein the at least one gas supply opening is offset in a region of the gas conducting channel at a non-zero angle relative to the transfer ignition groove.

22. The burner ring as claimed in claim 16, wherein the transfer ignition groove is uncovered its upper end.

23. The burner ring as claimed in claim 16, wherein the transfer ignition groove is located on a top side of the gas conducting channel and the at least one gas supply opening enters a bottom half of the gas conducting channel.

24. The burner ring as claimed in claim 16, wherein the outer circumference includes a notched upper edge aligned with and positioned in a plane above the transfer ignition groove, the notch having a width that is wider than the gas conducting channel.

25. The burner ring as claimed in claim 16, wherein the gas conducting channel is substantially parallel to the transfer ignition groove.

26. The burner ring as claimed in claim 16, wherein the gas conducting channel and the outlets are independently connected to the distribution chamber.

27. A gas burner comprising the burner ring as claimed in claim 16, the gas burner further comprising:

an inner burner secured within an inner region defined by the burner ring, and an ignition plug located at the inner region and adapted to ignite an inner flame from the inner burner, wherein the transfer ignition groove is adapted to transfer a flame from the inner region or inner burner to the gas outlets on the outer circumference of the burner ring, to ignite an outer flame of the burner ring.

28. The burner ring as claimed in claim 1, wherein the transfer ignition groove and the gas conducting channel have substantially equal lengths.

29. The burner ring as claimed in claim 1, wherein the gas conducting channel and the transfer ignition groove are at least partially coextensive in a radial direction.

* * * * *